US007314042B2

(12) United States Patent
Hanawa

(10) Patent No.: US 7,314,042 B2
(45) Date of Patent: Jan. 1, 2008

(54) EXHAUST GAS RECIRCULATION SYSTEM FOR A V-TYPE INTERNAL COMBUSTION ENGINE, AND ENGINE INCLUDING SAME

(75) Inventor: Kaoru Hanawa, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/389,893

(22) Filed: Mar. 27, 2006

(65) Prior Publication Data

US 2006/0219229 A1 Oct. 5, 2006

(30) Foreign Application Priority Data

Mar. 30, 2005 (JP) ..... 2005-096969

(51) Int. Cl.
*F02M 25/07* (2006.01)
*F02B 47/08* (2006.01)

(52) U.S. Cl. ..... 123/568.17; 123/568.23

(58) Field of Classification Search ..... 123/568.11, 123/568.13, 568.15, 568.17, 568.18, 568.19, 123/568.2, 568.21, 184.31, 184.33, 184.34, 123/568.23, 568.24; 701/108
See application file for complete search history.

(56) References Cited

U.S. PATENT DOCUMENTS 3,237,615 A * 3/1966 Daigh ..... 123/568.17
3,512,509 A * 5/1970 Daigh ..... 123/568.17
3,513,816 A * 5/1970 Daigh ..... 123/568.17
4,615,324 A * 10/1986 Choushi et al. ..... 123/568.17
4,693,226 A * 9/1987 Choma ..... 123/568.17
5,056,309 A * 10/1991 Linder et al. ..... 123/568.17
5,490,488 A * 2/1996 Aversa et al. ..... 123/184.31
7,059,310 B2 * 6/2006 Altenschmidt et al. 123/568.18

FOREIGN PATENT DOCUMENTS

JP 2002-089254 3/2002

* cited by examiner

*Primary Examiner*—Willis R. Wolfe, Jr.
(74) *Attorney, Agent, or Firm*—Carrier Blackman & Associates, P.C.; William D. Blackman; Joseph P. Carrier

(57) ABSTRACT

An EGR control valve is disposed on a V-type internal combustion engine such that the engine is compact as a whole. In the internal combustion engine, cylinders are provided with the cylinders spaced apart from each other in a V-shape, and exhaust gas obtained from an exhaust port of the rear cylinder is supplied to intake ports of the respective cylinders via a single EGR control valve through exhaust-gas supply channels having a branching chamber. The EGR control valve is provided in a V bank space between the cylinders. In addition, the EGR control valve is disposed at the rear of the front cylinder, so that the cooling of the EGR control valve due to exposure to the wind caused by vehicle travel is inhibited, and the exhaust gas is maintained at a high temperature during recirculation.

13 Claims, 6 Drawing Sheets

EXHAUST GAS RECIRCULATION SYSTEM FOR A V-TYPE INTERNAL COMBUSTION ENGINE, AND ENGINE INCLUDING SAME

CROSS-REFERENCE TO RELATED APPLICATIONS

The present invention claims priority under 35 USC 119 based on Japanese patent application No. 2005-096969, filed on Mar. 30, 2005. The subject matter of this priority document is incorporated by reference herein.

BACKGROUND OF THE INVENTION

1. Field of the Invention

The present invention relates to a V-type internal combustion engine in which a plurality of cylinders, spaced apart from each other in a V-shape, are provided on a crankcase. More particularly, the present invention relates to a V-type internal combustion engine including a control valve for an exhaust gas recirculation system (EGR), in which exhaust gas is recirculated into intake ports of the internal combustion engine to reduce nitrogen oxides (NOx) in the exhaust gas.

2. Description of the Background Art

With regard to internal combustion engines used for power sources of vehicles, such as motorcycles, it is know to use a V-type internal combustion engine in which a plurality of cylinders are disposed in a V-shape. The V-type configuration of the internal combustion engine makes it possible to make the internal combustion engine more compact, and reduce vibration resulting from the operation of the internal combustion engine, for example. In particular, for vehicles in which mounting space for the internal combustion engine is limited, such as motorcycles, the V-type internal combustion engine is known to be useful.

In addition, it is known to use an exhaust gas recirculation system (EGR) for recirculating exhaust gas into intake ports of an internal combustion engine, as well as a secondary air supply system for supplying secondary air into exhaust gas, for the purpose of cleaning the exhaust gas.

With regard to the secondary air supply system, an invention is known in which a secondary-air supply switching valve is disposed on the side opposite the direction of the offset of the rearward-inclined cylinder in a V-shaped space (V bank space) created between the cylinders of the V-type internal combustion engine. Placement of the valve in this location increases the cooling efficiency of the rearward-inclined cylinder, which is less prone to being blown against by the wind caused by vehicle travel, and also increases the cooling efficiency of the secondary-air supply switching valve. Such a configuration is disclosed, for example, in Japanese Patent Laid-Open No. 2002-89254.

In this type of system, a problem occurs in which the disposition of piping from an exhaust port side to an intake port side becomes complicated when the exhaust gas recirculation system is annexed to the internal combustion engine. In particular, optimal disposition of the EGR control valve is an issue when the exhaust gas recirculation system is annexed to the V-type internal combustion engine. Specifically, it is desirable to dispose the EGR control valve so that the V-type internal combustion engine becomes compact as a whole, without impairing the structural advantages of the V-type internal combustion engine.

An additional problem lies in that since, with regard to the V-type internal combustion engine, exhaust gas has to be recirculated to combustion chambers of the cylinders spaced apart in a V-shape, the structure of the internal combustion engine as a whole becomes complicated, and the internal combustion engine becomes large, unless the disposition, branching or the like of the recirculation channels of exhaust gas is contrived. In this case, an embodiment in which the EGR control valve is provided on each cylinder results in increase in the number of parts and increase in cost.

In an exhaust gas recirculation system, in order to prevent the ingredients of exhaust gas from attaching to wall surfaces of the recirculation passages, the exhaust gas must be maintained at a high temperature when recirculated into the combustion chambers, whereby the exhaust gas is efficiently cleaned. Accordingly, in addition to the size reduction mentioned above, it is desirable to find a way to recirculate exhaust gas while maintaining the recirculated exhaust gas at a high temperature. This is especially true when the V-type internal combustion engine is mounted on a motorcycle, since the degree of cooling of the internal combustion engine and the exhaust pipes by the wind caused by vehicle travel becomes large, it is very important to contrive a way to recirculate exhaust gas without much cooling.

The present invention has been made in consideration of the above described circumstances, and an object thereof is to provide, by disposing the EGR control valve annexed to the V-type internal combustion engine in a contrived manner, a V-type internal combustion engine which is compact as a whole, without impairing the compact structural advantage of the V-type internal combustion engine.

Another object of the present invention is to provide, in the same way, a V-type internal combustion engine which recirculates exhaust gas into the cylinders via a single EGR control valve, and, in addition, which makes it possible to minimize increase in the number of parts and increase in cost, and has a simple structure as a whole, by disposing and branching the recirculation channels of exhaust gas in a rational structure.

Still another object of the present invention is to provide, in the same way, a V-type internal combustion engine which can maintain high exhaust-gas cleaning efficiency by recirculating the exhaust gas at as high a temperature as possible, even if the internal combustion engine is cooled as the vehicle travels.

SUMMARY

A V-type internal combustion engine according to the present invention includes a plurality of cylinders provided on a crankcase, the cylinders spaced apart from each other in a V-shape. The invention is characterized in that an EGR control valve is used to recirculate exhaust gas supplied from an exhaust port of the internal combustion engine into intake ports of the internal combustion engine. The EGR control valve is provided in a V-shaped space (V bank space) between cylinder blocks, and channels for supplying exhaust gas from the EGR control valve to the intake ports of the cylinders are provided.

Accordingly, since the EGR control valve is disposed within the characteristic V bank space in the V-type internal combustion engine, the V-type internal combustion engine does not become large as a whole, and it is possible to provide the EGR control valve as a compact structure. In addition, since the EGR control valve is disposed in the V bank space, it is possible to inhibit the cooling of the EGR control valve due to exposure to the wind caused by vehicle travel, and it is therefore possible to suppress the drop in temperature of exhaust gas within the EGR control valve.

Moreover, since the EGR control valve is located substantially between the cylinders, the structure for recirculating exhaust gas into the cylinders via the single EGR control valve is simple, and it is possible to simplify the overall structure of the V-type internal combustion engine, and to make the V-type internal combustion engine compact without significant increase in the number of parts and increase in cost.

In a further aspect, the V-type internal combustion engine according to the present invention is characterized in that the channels for supplying exhaust gas from the EGR control valve to the intake ports of the cylinders include a single upstream passage connected to the EGR control valve, and a branching chamber connected to the upstream passage. The branching chamber has a plurality of one-way valves for preventing backflow from the intake ports of the cylinders. The channels for supply exhaust gas also include a plurality of downstream passages connected to one-way valve portions of the branching chamber, the downstream passages also being connected to the intake ports of the respective cylinders.

Accordingly, since the EGR control valve is shared between the cylinders and since the exhaust-gas supply channels extending from the EGR control valve are branched to the respective cylinders via the branching chamber, it is possible to reduce the number of parts as compared to the number of parts required when the exhaust-gas supply channel is provided for each cylinder.

In a further aspect, the V-type internal combustion engine according to the present invention is characterized in that, when the V-type internal combustion engine is mounted on a vehicle in a transverse manner so that a crankshaft extends in a left and right direction with respect to a travel direction of the vehicle, the cylinders, spaced apart from each other in the V-shape, are disposed offset in a left and right direction which is a vehicle width direction. In addition, the EGR control valve is provided at the rear of the cylinder located forward with respect to the travel direction of the vehicle.

Accordingly, since the EGR control valve is disposed to the rear of the front cylinder with respect to the travel direction, it is possible to inhibit the cooling of the EGR control valve due to exposure to the wind caused by vehicle travel, and it is therefore possible to recirculate the exhaust gas while maintaining it at a high temperature.

Since, in the V bank space, the front of the cylinder located rearward with respect to the travel direction of the vehicle is exposed to the cooling effect due to the wind caused by vehicle travel, it is preferable to dispose a throttle valve in this place, in order to increase the air intake efficiency. With the present invention, even if the throttle valve is disposed in front of the cylinder located rearward with respect to the travel direction of the vehicle, it is possible to use the dead space, which is a side area of the throttle valve, as the place where the EGR control valve is disposed, whereby the V-type internal combustion engine is even more compact.

In a further aspect, the V-type internal combustion engine according to the present invention is characterized in that when the V-type internal combustion engine is mounted on a vehicle, exhaust gas is introduced into the EGR control valve from one of the cylinders spaced apart from each other in the V-shape, the one cylinder being located rearward with respect to the travel direction of the vehicle.

Accordingly, the rear cylinder, and the exhaust pipe extended from the cylinder, are less prone to being blown against by the wind caused by vehicle travel because these components are situated behind the front cylinder. As a result, that the exhaust gas is introduced into the EGR control valve at a high temperature, and the ingredients of exhaust gas are prevented from attaching to wall surfaces of the recirculation passages during recirculation of the high temperature exhaust gas, which makes it possible to obtain excellent exhaust-gas cleaning efficiency.

According to the present invention, the EGR control valve is provided in the V bank space in the V-type internal combustion engine, and the channels for supplying exhaust gas from the EGR control valve to the intake ports of the cylinders are provided so that the V-type internal combustion engine does not become large as a whole, and it is possible to dispose the EGR control valve in a compact structure. In addition, it is possible to recirculate exhaust gas into the cylinders via the single EGR control valve. Moreover, it is possible to suppress the drop in temperature of exhaust gas in the EGR control valve, which is exposed to the wind caused by vehicle travel.

In addition, according to the present invention, since the exhaust gas supplied from the EGR control valve is split via the branching chamber, the branching chamber having a plurality of one-way valves for preventing backflow, and is introduced into the intake ports of the cylinders, it is possible to reduce the number of parts as compared to the number of parts required when the exhaust-gas supply channel extended from the EGR control valve is provided for each cylinder.

In addition, according to the present invention, since, in the V-type internal combustion engine, the cylinders are disposed offset in the left and right direction with respect to the travel direction of the vehicle, and the EGR control valve is disposed to the rear of the cylinder located forward with respect to the travel direction of the vehicle, it is possible to inhibit the cooling of the EGR control valve due to exposure to the wind caused by vehicle travel. Moreover, it is therefore possible to recirculate high temperature the exhaust gas, which makes it possible to obtain excellent exhaust-gas cleaning efficiency.

In addition, according to the present invention, since the exhaust gas is introduced into the EGR control valve from the cylinder located rearward with respect to the travel direction of the vehicle, high temperature exhaust gas is introduced into the EGR control valve from the position where the effect of cooling by the wind caused by vehicle travel is small, whereby exhaust gas is recirculated at a high temperature, which makes it possible to obtain excellent exhaust-gas cleaning efficiency.

Modes for carrying out the present invention are explained below by reference to an embodiment of the present invention shown in the attached drawings. The above-mentioned object, other objects, characteristics and advantages of the present invention will become apparent form the detailed description of the embodiment of the invention presented below in conjunction with the attached drawings.

DETAILED DESCRIPTION

A selected illustrative embodiment of the invention will now be described in some detail, with reference to the drawings. It should be understood that only structures considered necessary for clarifying the present invention are described herein. Other conventional structures, and those of ancillary and auxiliary components of the system, are assumed to be known and understood by those skilled in the art. Concrete description will be given of a V-type internal combustion engine 1 according to the present invention with the use of an example in which the V-type internal combustion engine is mounted on a motorcycle. Throughout the description, references to "front" and "rear" directions are to be interpreted with respect to the travel direction of the motorcycle as viewed by an operator thereof.

Figure 6:
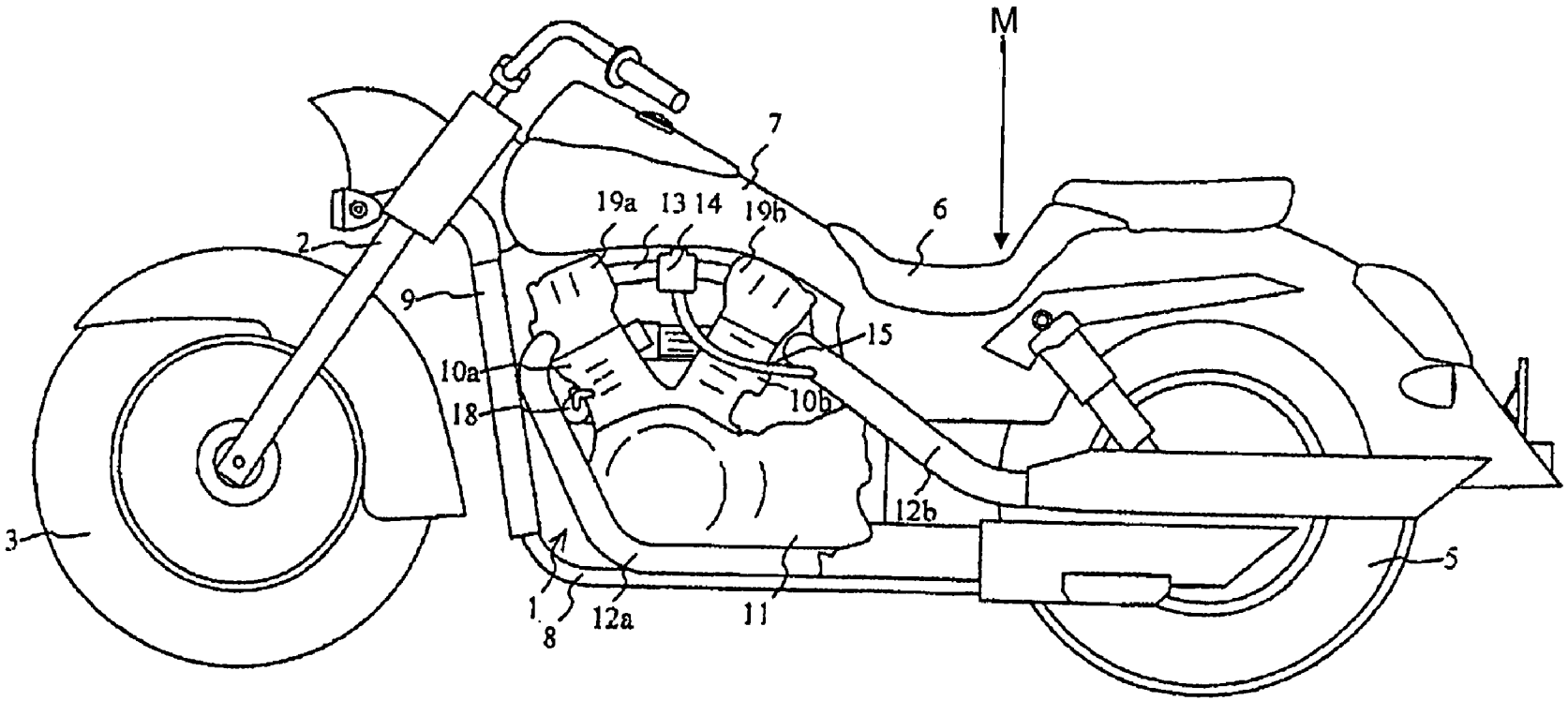
FIG. 6 is a side view of a motorcycle on which the V-type internal combustion engine according to the embodiment of the present invention is mounted.

The motorcycle M, on which the V-type internal combustion engine 1 of this example is mounted, is illustrated in FIG. 6. The motorcycle M has a front wheel 3 freely rotatably supported on a shaft at the lower end of a front fork 2. The front fork 2 is pivotally supported by a body frame. The motorcycle M has a rear wheel 5 freely rotatably supported on a shaft at the rear end of a rear fork. The front end of the rear fork is supported by the body frame such that the rear fork swings freely in a vertical direction.

A fuel tank 7, which is attached to the body frame, is provided between the front fork 2 and a seat 6. The V-type internal combustion engine 1, which is supported by a hanger 8 constituting the body frame, is provided under the fuel tank 7. A radiator 9 of coolant for cooling the V-type internal combustion engine 1 is provided on the hanger 8.

The V-type internal combustion engine 1 has a structure in which a plurality of cylinders (two cylinders 10*a*, 10*b* in this example), spaced apart from each other in a V-shape, are provided on a crankcase 11. The cylinder 10*a* is located on the front side of the engine 1, and is inclined toward the front. The cylinder 10*b* is located on the rear side of the engine 1, and is inclined toward the rear. Exhaust pipes 12*a*, 12*b* extend rearward from the cylinders 10*a*, 10*b*, respectively.

An intake pipe 13 connected to the cylinders 10*a*, 10*b* is disposed in the V-shaped space, also referred to herein as the V bank space, which exists between the cylinders 10*a* and 10*b* of the V-type internal combustion engine 1. Also disposed in the V-shaped space is a control valve 14 of an exhaust gas recirculation system (EGR) for recirculating exhaust gas into combustion chambers of the internal combustion engine 1 to reduce nitrogen oxides (NOx) in the exhaust gas.

It should be noted that the exhaust gas is introduced to the EGR control valve 14 from the exhaust pipe 12*b* of the rear cylinder 10*b* through an exhaust-gas introducing pipe 15. In addition, it should be noted that by controlling the opening and closing of the control valve 14 via a solenoid in a well-known manner, the exhaust gas introduced from the exhaust-gas introducing pipe 15 is supplied to intake ports of both of the cylinders 10*a*, 10*b*, and recirculated into the combustion chambers thereof.

In a front portion of the cylinder 10*a*, located on the front side of the engine 1 with respect to the travel direction of the motorcycle, an air compressor 18 is provided in an exposed manner. The air compressor 18 is driven by the V-type internal combustion engine 1. In order to directly inject fuel-air mixture into the combustion chambers in the cylinders, the air compressor 18 supplies compressed air to charge injectors 30 (see FIG. 1) which are provided within the cylinder head cover portions 19*a*, 19*b* of the respective cylinders 10*a*, 10*b*.

Specifically, the air compressor 18 takes in and compresses the air passed through an air filter (not shown), and supplies the compressed air to the charge injectors 30 through a supply channel to be described later. The charge injectors mix a proper, controlled amount of fuel with the compressed air, and directly inject the mixture into the combustion chambers.

Figure 1:
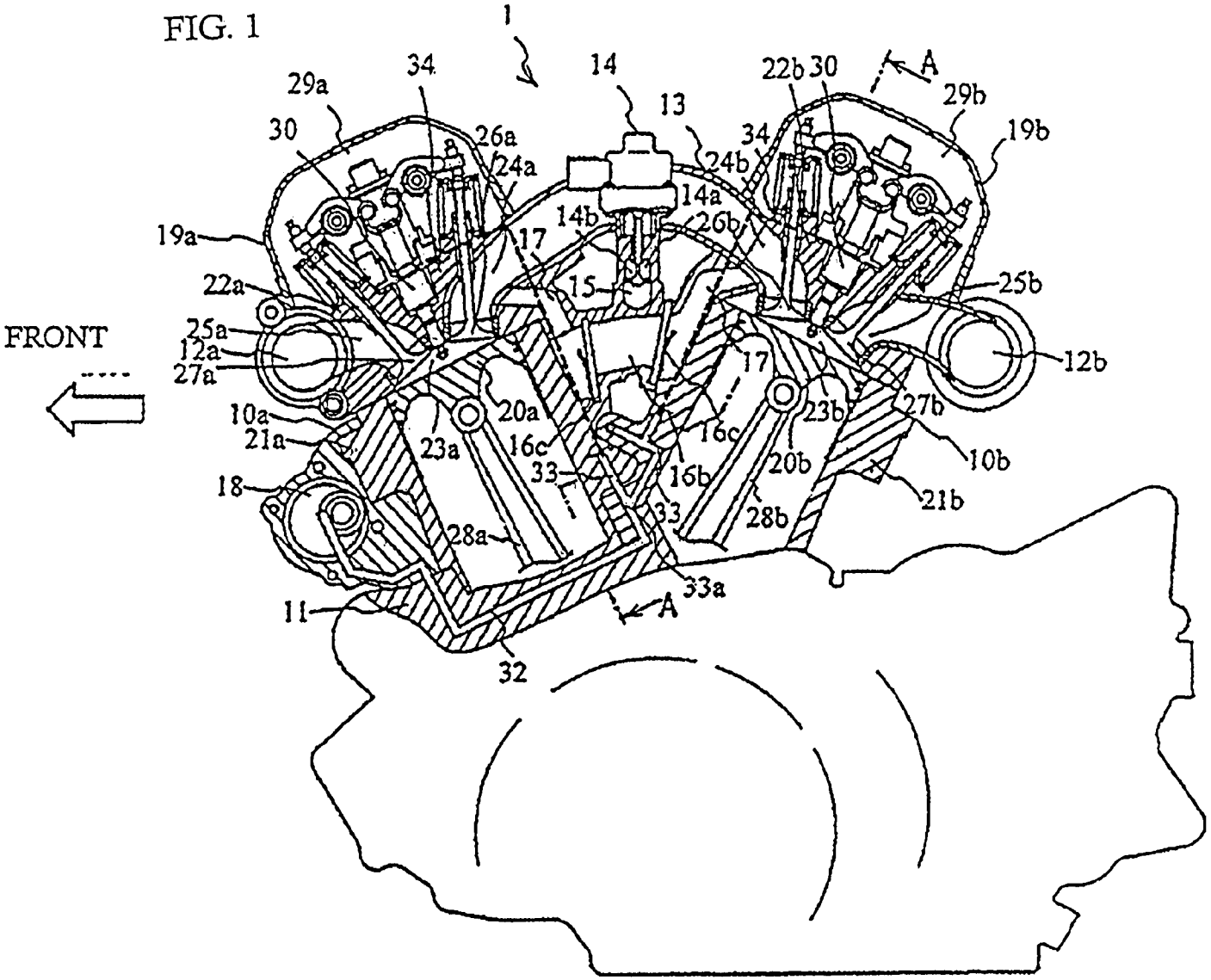
FIG. 1 is a partial cross-sectional side view of a V-type internal combustion engine according to an embodiment of the present invention showing an EGR control valve disposed in the V-shaped space between the front and rear cylinders.

In FIG. 1, the V-type internal combustion engine 1 of this example is shown in a partially sectional side view.

In the cylinders 10*a*, 10*b*, the combustion chambers 23*a*, 23*b* are formed by providing cylinder heads 22*a*, 22*b* on the upper ends of cylinder blocks 21*a*, 21*b* which freely slidably house pistons 20*a*, 20*b*. The pistons 20*a*, 20*b* are connected, via connecting rods 28*a*, 28*b*, to a crankshaft which is housed in the crankcase 11. At least one intake port 24*a* (24*b*) and at least one exhaust port 25*a* (25*b*) are opened to each combustion chamber 23*a* (23*b*). The intake ports 24*a*, 24*b* and the exhaust ports 25*a*, 25*b* are opened and closed by intake valves 26*a*, 26*b* and exhaust valves 27*a*, 27*b* which are freely slidably provided to the cylinder heads 22*a*, 22*b*.

The intake valves 26*a*, 26*b* and the exhaust valves 27*a*, 27*b* perform an opening and closing operation at predetermined intake and exhaust timings when cam mechanisms 29*a*, 29*b* provided to the cylinder heads 22*a*, 22*b* are driven due to the operation of the V-type internal combustion engine 1 in a well-known manner. The intake and exhaust valves thus allow air to be introduced into the combustion chambers 23*a*, 23*b* from the intake pipe 13 connected to the intake ports 24*a*, 24*b*, and allow exhaust gas to be discharged from the combustion chambers 23*a*, 23*b* into the exhaust pipes 12*a*, 12*b* connected to the exhaust ports 25*a*, 25*b*.

Exhaust gas is introduced from the exhaust pipe 12*b* into the EGR control valve 14 of the exhaust gas recirculation system through the exhaust-gas introducing pipe 15. By controlling the opening and closing of a valve element 14*a* of the control valve 14, the exhaust gas introduced from the exhaust-gas introducing pipe 15 is directed into a valve chamber 14*b*, and is introduced into a branching chamber 16*b* through a communicating pipe 16*a*. The branching chamber 16*b* is provided with a pair of one-way valves (for example, reed valves) 16*c* for preventing backflow to the branching chamber 16*b*. Supply pipes 17 are connected to the branching chamber 16*b* with the respective reed valves interposed therebetween. The other ends of the exhaust-gas supply pipes 17 communicate with the intake pipes 13 at points near the intake ports 24*a*, 24*b*. The exhaust gas supplied from the supply pipes 17 is introduced from the intake ports 24*a*, 24*b* into the combustion chambers 23*a*, 23*b*.

Figure 4:
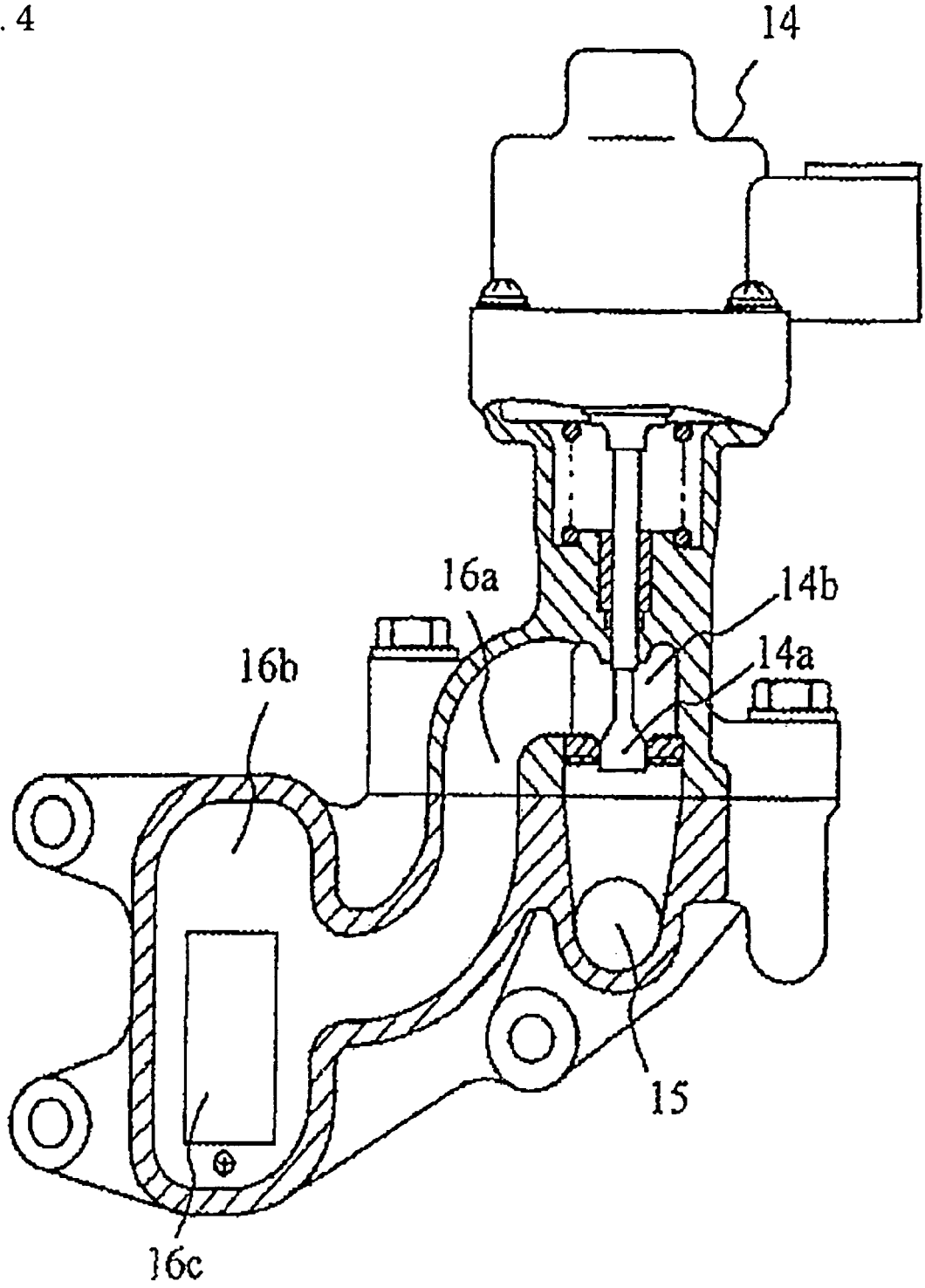
FIG. 4 is a cross-sectional view of the EGR control valve portion of the V-type internal combustion engine according to the embodiment of the present invention, showing the actuator of the EGR control valve disposed above the valve thereof.

In FIG. 4, there is shown a cross-sectional structure of a portion of the engine 1 ranging from the exhaust-gas introducing pipe 15 to the branching chamber 16*b* as viewed from a direction in which the viewpoint is changed from that of FIG. 1 by 90°.

High temperature exhaust gas is introduced from the exhaust pipe 12*b* of the rear cylinder into the single EGR control valve 14 disposed in the V bank space. The exhaust gas is supplied from the EGR control valve 14, through the communicating pipe (the upstream passage) 16*a*, to the branching chamber 16*b* provided with the two reed valves 16*c*. The exhaust gas which flows through the supply pipes (the downstream passages) 17 is supplied from the branching chamber 16*b* to the intake ports 24*a*, 24*b* through the reed valves 16*c*. That is, by controlling the opening and closing of the control valve 14 in accordance with the combustion timing of the internal combustion engine, a proper amount of exhaust gas introduced from the exhaust pipe 12*b* into the branching chamber 16*b* is prevented from flowing backward by the reed valves 16*c*, and is recirculated from the exhaust-gas supply pipes 17 into the combustion chambers 23*a*, 23*b* through the intake ports 24*a*, 24*b*.

In this way, the exhaust gas supplied from the EGR control valve 14 is split and introduced into both of the front and rear cylinders 10*a*, 10*b* through the exhaust gas supply channels constituted of the communicating pipe (the upstream passage) 16*a*, the branching chamber 16*b*, and the supply pipes (the upstream passages) 17, so that the single EGR control valve 14 manages recirculation of the exhaust gas into both of the front and rear cylinders 10*a*, 10*b*.

With regard to the exhaust-gas recirculation system (EGR) for recirculating exhaust gas into the combustion chambers, it is preferable that the temperature of the recirculated exhaust gas be high. Since the exhaust gas is recirculated from the exhaust pipe 12*b*, and since the exhaust pipe 12*b* is located rearward of the rear cylinder 10*b* with respect to the travel direction of the vehicle where the exhaust gas is less cooled by the wind caused by motorcycle travel, the recirculated exhaust gas is maintained at a high temperature and it is possible to increase the effect of reducing nitrogen oxides (NOx).

As shown in FIG. 1, the cylinder heads 22*a*, 22*b* are provided with the charge injectors 30 for injecting fuel-air mixture, and injection tips of the charge injectors 30 face the respective combustion chambers 23*a*, 23*b* at the centers thereof.

The charge injectors 30, as described later, are controlled and operated with the aid of the solenoid drive, mix the compressed air supplied from the air compressor 18 and the fuel supplied from the fuel tank 7 to make a mixture, and directly inject the mixture into the respective combustion chambers 23*a*, 23*b*.

The cylinder blocks 21*a*, 21*b* are provided on the crankcase 11 with the cylinders spaced apart from each other in a V-shape. In the crankcase 11, a shared compressed-air supply channel 32 communicates with the air compressor 18 and is formed in the form of an internal conduit. The other end of the shared channel 32 opens to a base end portion of the V-shaped space created by the cylinder heads 22*a*, 22*b*. By attaching the cylinder blocks 21*a*, 21*b* to the crankcase 11, compressed-air supply channels 33, which are formed in the cylinder blocks 21*a*, 21*b* in the form of internal conduits, and the shared channel 32 are allowed to communicate with each other in an airtight manner.

The compressed-air supply channel 33 branches into two channels in the vicinity 33*a* of a portion where the cylinder blocks 21*a*, 21*b* meet. The branched compressed-air supply channels 33 extend to the cylinder heads 22*a*, 22*b* along the side walls of the cylinder blocks 21*a*, 21*b* on the sides thereof facing each other (the side walls on the V-shaped space side). In order to simplify the drawing, in FIG. 1, the compressed-air supply channels 33 are partially shown by dashed lines.

The upper ends of the compressed-air supply channels 33 open in the surfaces where the cylinder blocks are joined to the cylinder heads. When the cylinder heads 22*a*, 22*b* are attached to the respective cylinder blocks 21*a*, 21*b*, the compressed-air supply channels 33 and compressed-air supply channels 34 are formed, in the form of conduits, in the respective cylinder heads 22*a*, 22*b* so as to communicate with each other in an airtight manner.

Figure 2:
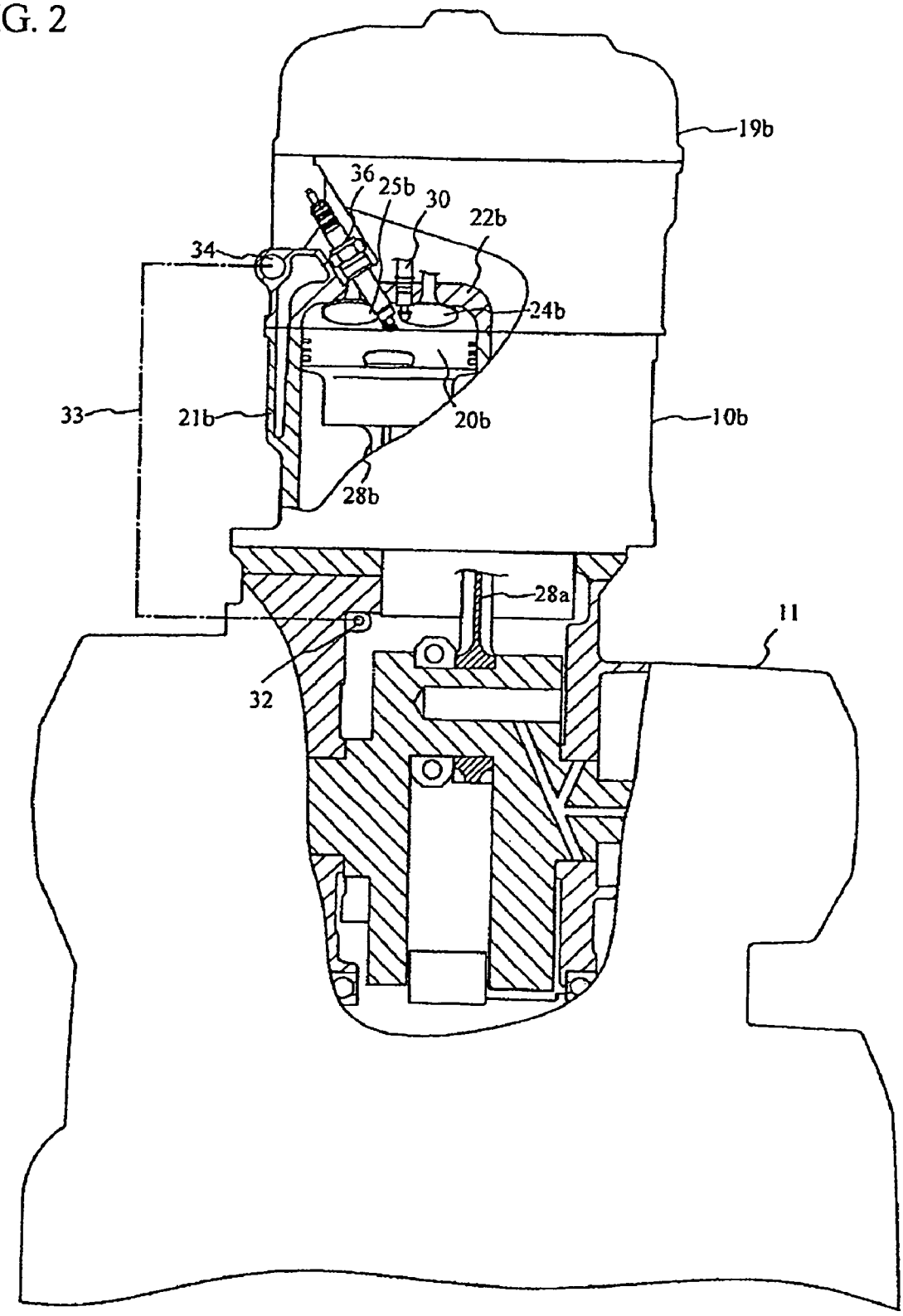
FIG. 2 is a partial cross-sectional front view of the V-type internal combustion engine taken along the line A-A in FIG. 1 showing the configuration of the compressed air channels within the engine.

In FIG. 2, there is shown a partial cross section of the V-type internal combustion engine 1 taken along the line A-A in FIG. 1 to explain the relation between the shared channel 32, the compressed-air supply channels 33, and the compressed-air supply channels 34.

Specifically, by assembling the internal combustion engine 1 so that the cylinder blocks 21*a*, 21*b* are attached to the crankcase 11, and the cylinder heads 22*a*, 22*b* are attached to the respective cylinder blocks 21*a*, 21*b*, then the compressed-air supply channels, extending from the air compressor 18 to the charge injectors 30 in the cylinder head portions, are formed by the shared channel 32, the compressed-air supply channels 33, and the compressed-air supply channels 34.

As illustrated in FIG. 2, a spark plug 36 is disposed on the cylinder head 22*b* so as to face the combustion chamber 23*b*.

By forming the compressed-air supply channels extending from the air compressor 18 to the charge injectors 30 in this way, it is possible to prevent condensation from occurring due to the cooling of the compressed air flowing through the compressed-air supply channels 33 by the wind caused by vehicle travel. In addition, the lengths of the compressed-air supply channels reaching the charge injectors 30 are equalized, so that excellent injection operation of the mixture is enabled.

Figure 3:
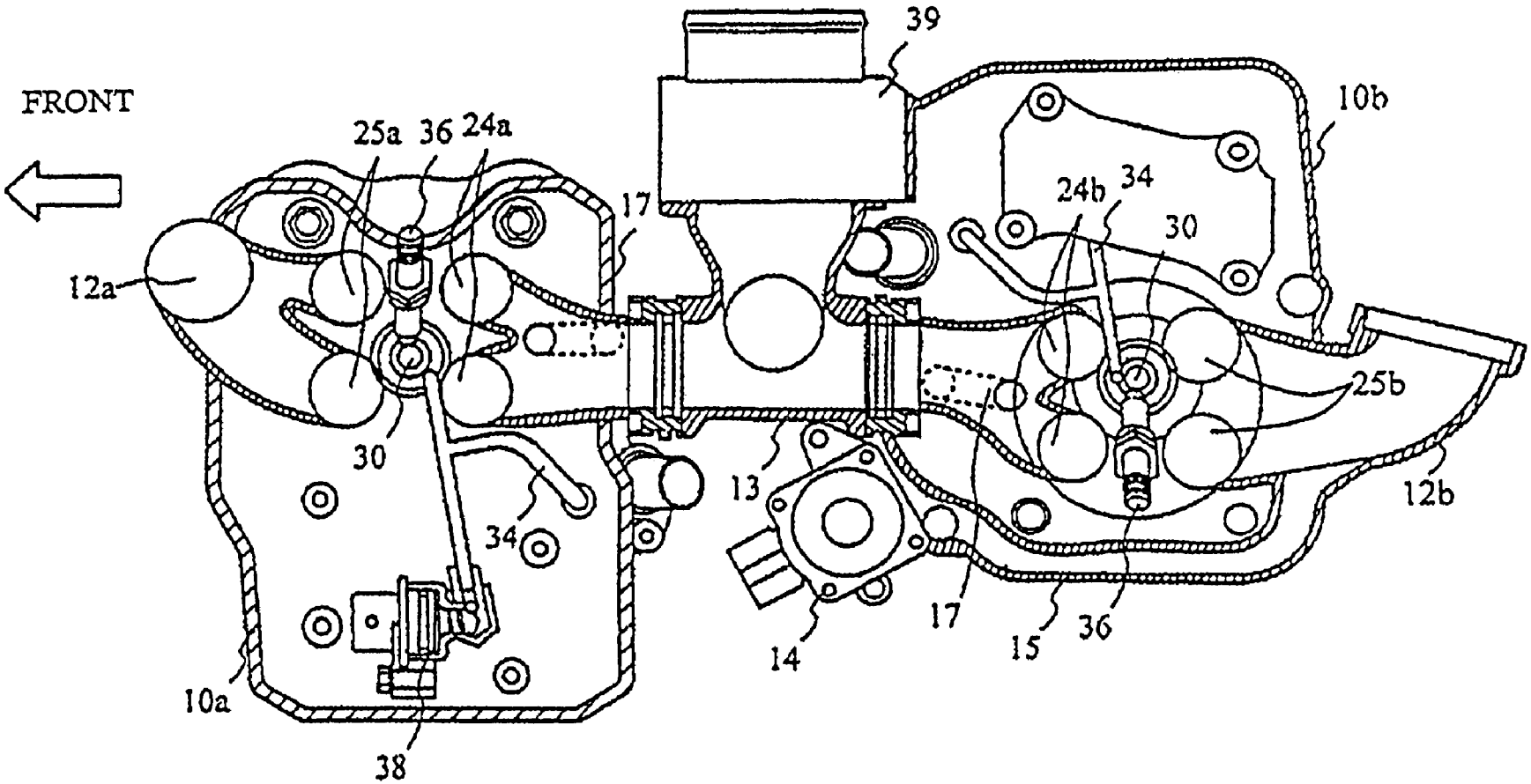
FIG. 3 is a cross-sectional plan view of the V-type internal combustion engine of FIG. 1 showing the regulator for the compressed air channels, and showing the throttle disposed to one side of the V-shaped space between the front and rear cylinders.

In FIG. 3, the cylinder head portions of the V-type internal combustion engine 1 are shown in a cross-sectional plan view to explain a structure in which the compressed-air supply channels 34 reach the charge injectors 30, and to explain the position of the EGR control valve 14.

Each of the compressed-air supply channels 34, which communicate with the compressed-air supply channels 33 in the cylinder blocks 21*a*, 21*b*, is branched into two channels, one channel configured to communicate with an air pressure regulator 38 provided in the cylinder head portion, and the other channel configured to communicate with a compressed air chamber of the mixture injection valve 30. That is, the air pressure of the compressed air introduced into the compressed-air supply channels 34 is regulated to a predetermined air pressure by the air pressure regulator 38, and the compressed air, the pressure of which has been regulated, is supplied to the compressed air chambers of the charge injectors 30.

The V-type internal combustion engine 1 is mounted in a transverse manner so that the crankshaft extends in the left and right direction with respect to the travel direction of the vehicle. The front and rear cylinders 10*a*, 10*b* are disposed so as to be offset with respect to each other in the left and right direction which is the vehicle width direction. The EGR control valve 14 is disposed to the rear of the front cylinder 10*a*, and is attached to the rear cylinder 10*b* via a bracket. The exhaust-gas introducing pipe 15, which introduces exhaust gas from the exhaust pipe 12*b* connected to the rear cylinder 10*b*, extends along the periphery of the rear cylinder 10*b*. The EGR control valve 14 and the exhaust gas introducing pipe 15 are both located to the rear of the front cylinder 10*a* with respect to the travel direction of the vehicle.

Accordingly, since the front cylinder 10*a* blocks the wind caused by traveling of the vehicle, it is possible to inhibit wind-induced cooling of the EGR control valve 14 and the exhaust gas introducing pipe 15, so that it is possible to introduce exhaust gas, which is maintained at a high temperature, from the rear exhaust pipe 12*b* into the EGR control valve 14, and thus to recirculate the exhaust gas.

The exhaust gas recirculation system (the EGR system) is provided with an actuator (such as solenoids) for driving the EGR control valve 14. It is preferable that the actuator be provided in an upper portion of the EGR control valve 14 which is disposed behind the front cylinder 10*a* as described above. It is also preferable that the actuator is disposed so as to be located above the cylinder head 22*a* of the front cylinder 10*a* (FIG. 1). With this disposition, the actuator is cooled by the wind caused by vehicle travel, and therefore drives the EGR control valve 14 in a good condition. In addition, the cooling of the lower portion of the EGR control valve 14 by the wind caused by vehicle travel is inhibited due to the presence of the cylinder 10*a*, so that it is possible to recirculate exhaust gas with the temperature thereof kept high.

Moreover, in this example, a throttle valve 39 is disposed to one side of the rear of the front cylinder 10*a* in the V bank space (FIG. 3). The throttle valve 39 regulates the amount of air supplied to the intake pipe 13. By positioning the throttle valve 39 in this location, the throttle valve 39 is cooled by the wind caused by vehicle travel. In this way, a drop in the air intake efficiency due to heating of air can be prevented.

If the throttle valve 39 is disposed in this way, generally speaking, a side area of the throttle valve 39 in the V bank space becomes a dead space. However, since the EGR control valve 14 is disposed in the side area of the throttle valve 39 as described above, the dead space is effectively used.

Figure 5:
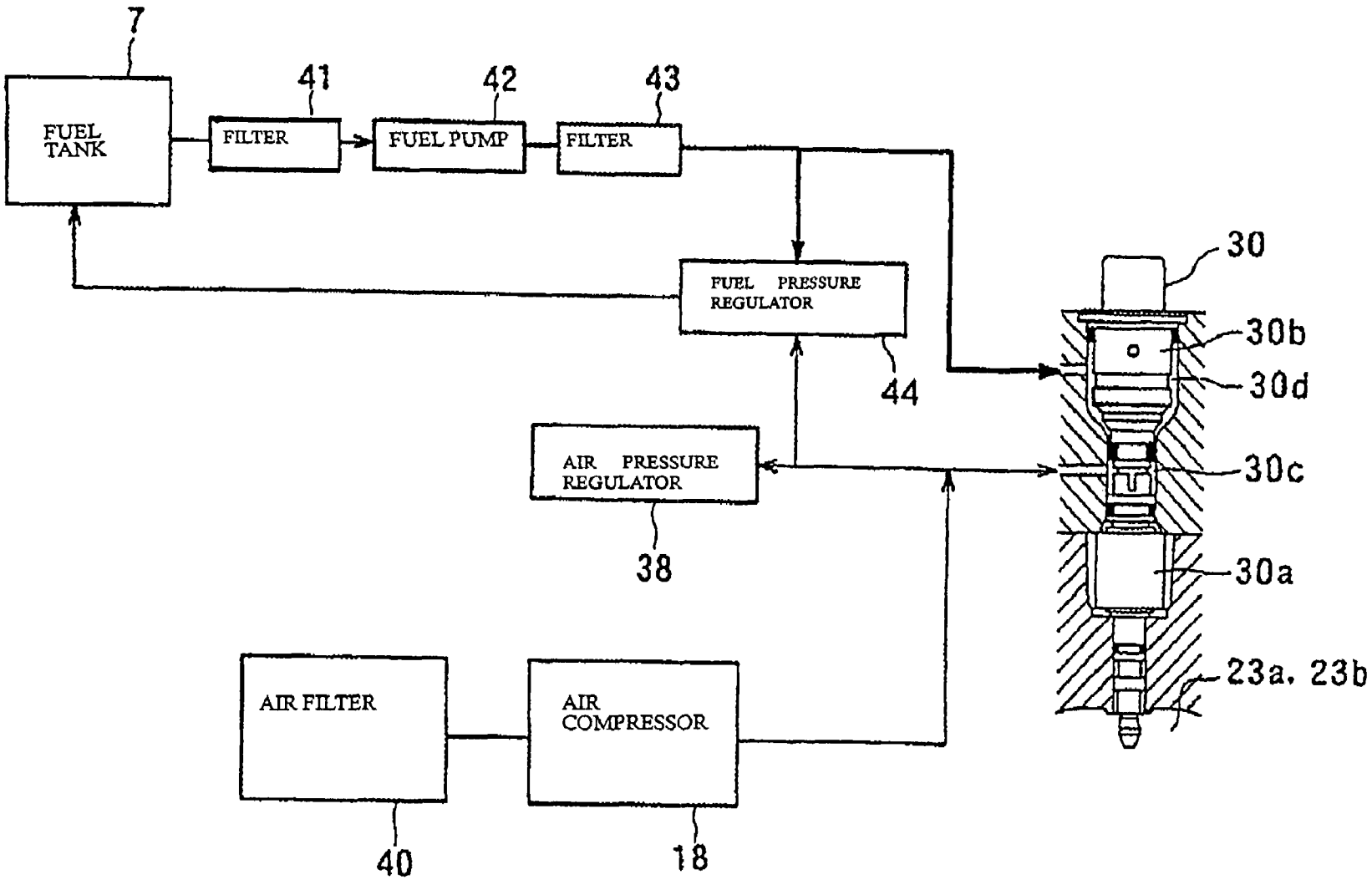
FIG. 5 is a diagram showing a system for supplying compressed air and fuel to a mixture injection valve of the V-type internal combustion engine according to the embodiment of the present invention.

In FIG. 5, a system is illustrated in which compressed air and fuel is supplied to the charge injectors 30. With reference to FIG. 5, the injection operation of the mixture carried out by the charge injectors 30 will be described.

Each charge injector 30 includes: a mixture valve 30*a* the lower end of which faces the combustion chamber 23*a* (23*b*); and a fuel valve 30*b* coaxially provided above the mixture valve 30*a*. The charge injector 30 directly injects the mixture, which is made by mixing fuel into compressed air, into the combustion chamber 23*a* (23*b*) by controlling and operating the mixture valve 30*a* and the fuel valve 30*b* via a solenoid (not shown).

The air taken in through the air filter 40 provided to the motorcycle is compressed by the air compressor 18, and the compressed air is supplied, through the compressed-air supply channel (the shared channel 32, the supply channels 33, 34), to the compressed air chamber 30*c* formed by the mixture valve 30*a*. The compressed air is introduced into the air pressure regulator 38 through the branched channel of the supply channel 34 to release excess pressure, so that the compressed air, the pressure of which has been regulated to the predetermined pressure, is supplied to the compressed air chamber 30*c*.

Meanwhile, a fuel pump 42 provided to the motorcycle takes in fuel from the fuel tank 7 through a fuel filter 41, and the fuel pumped by the fuel pump 42 is supplied to a fuel chamber 30*d* of the charge injector 30. The fuel chamber 30*d* is formed by the fuel valve 30*b*. The fuel split from the channel reaching the charge injection valve 30 is introduced to a fuel pressure regulator 44 to return excess fuel to the fuel tank 7. In this way, the fuel the pressure is regulated so that the pressure is higher than the air pressure in the compressed air chamber 30*c* and so that the pressure difference therebetween is kept constant. The pressure regulated fuel is supplied to the fuel chamber 30*d*.

When the solenoid is energized, the fuel valve 30*b* is opened while the compressed air is supplied to the compressed air chamber 30*c*, and the fuel is supplied to the fuel chamber 30*d* in the above described way. As a result, the fuel measured via the fuel chamber 30*d* is injected into the compressed air chamber 30*c*, so that the fuel and the compressed air are mixed.

Subsequently, once the solenoid is energized, and the mixture valve 30*a* is thus opened, the mixture in the compressed air chamber 30*c* is injected into the combustion chambers 23*a*, 23*b* because of the pressure thereof, is ignited by the spark plug 36, and burns.

Further subsequently, the exhaust gas produced as a result of combustion of the mixture in the combustion chambers 23*a*, 23*b* is discharged from the exhaust ports 25*a*, 25*b* into the exhaust pipes 12*a*, 12*b*. The high-temperature exhaust gas discharged into the exhaust pipe 12*b* is introduced from the exhaust-gas introducing pipe 15 into the EGR control valve 14 by virtue of the internal pressure in the exhaust pipe 12*b*. The opening and closing of the control valve 14 is controlled via the solenoid, so that the exhaust gas is supplied from the EGR control valve 14 to the intake ports 24*a*, 24*b* through the exhaust-gas supply channels 16*a*, 16*b* and 17, and is recirculated into the combustion chambers 23*a*, 23*b*.

While a working example of the present invention has been described above, the present invention is not limited to the working example described above, but various design alterations may be carried out without departing from the present invention as set forth in the claims.

What is claimed is:

1. An internal combustion engine comprising a crankcase, and a plurality of cylinders provided on the crankcase, the cylinders spaced from each other in a V-shape such that a V-shaped space exists between the cylinders, wherein when the internal combustion engine is mounted on a vehicle, the cylinders are spaced from each other in a V-shape such that a first cylinder is inclined forward, and a second cylinder is inclined rearward, and the engine further comprising a control valve, and plural exhaust ports and plural intake ports communicating with an interior of the cylinders, wherein the control valve recirculates exhaust gas obtained from an exhaust port of the internal combustion engine into the intake ports of the internal combustion engine, the control valve disposed in the V-shaped space between cylinders, wherein channels are provided for supplying exhaust gas from the control valve to the intake ports of the cylinders, and wherein the actuator portion is disposed above a cylinder head of the first cylinder so as to be exposed to wind resulting from travel of the vehicle, and the valve portion is disposed behind the first cylinder so as to be substantially protected from exposure to wind resulting from travel of the vehicle.

2. An internal combustion engine comprising a crankcase, and a plurality of cylinders provided on the crankcase, the cylinders spaced from each other in a V-shape such that a V-shaped space exists between the cylinders, the engine further comprising a control valve, and plural exhaust ports and plural intake ports communicating with an interior of the cylinders, wherein the control valve recirculates exhaust gas obtained from an exhaust port of the internal combustion engine into the intake ports of the internal combustion engine, the control valve disposed in the V-shaped space between cylinders, wherein channels are provided for supplying exhaust gas from the control valve to the intake ports of the cylinders, and wherein the control valve comprises an actuator portion and a valve portion, and the control valve is configured such that when the control valve is attached to an internal combustion engine which is mounted in a vehicle, the control valve is oriented on the engine such that the actuator portion overlies the valve portion.

3. The internal combustion engine according to claim 2, wherein the channels for supplying exhaust gas from the control valve to the intake ports of the cylinders comprise a single upstream passage connected to the control valve;

a branching chamber connected to the upstream passage, the branching chamber having a plurality of one-way valves for preventing backflow into the branching chamber from the intake ports of the cylinders; and a plurality of downstream passages connected at one end to the branching chamber through the one-way valves, and connected at another end to the intake ports of the respective cylinders.

4. The internal combustion engine according to claim 2, wherein, when the internal combustion engine is mounted on a vehicle in a transverse manner so that a crankshaft of the engine extends in a left and right direction with respect to a travel direction of the vehicle, the cylinders are disposed offset with respect to each other in the left and right direction, and the cylinders are spaced from each other in a V-shape such that a first cylinder is inclined forward, and a second cylinder is inclined rearward, the control valve is provided behind the inclined forward cylinder with respect to the travel direction of the vehicle.

5. The internal combustion engine according to claim 2, wherein, when the internal combustion engine is mounted on a vehicle, and the cylinders are spaced from each other in a V-shape such that a first cylinder is inclined forward, and a second cylinder is inclined rearward, exhaust gas is introduced into the control valve from the rearward inclined cylinder with respect to the travel direction of the vehicle.

6. The internal combustion engine according to claim 2, wherein, when the internal combustion engine is mounted on a vehicle, and the cylinders are spaced from each other in a V-shape such that a first cylinder is inclined forward, and a second cylinder is inclined rearward, and wherein the internal combustion engine further comprises an air intake member disposed between the first and second cylinders, and an air intake throttle operatively connected to the air intake member, the control valve is disposed between the first and second cylinders so as to reside on one side of the air intake member, and the air intake throttle is disposed between the first and second cylinders so as to reside on a side of the air intake member opposed to the one side.

7. The internal combustion engine according to claim 2, wherein, when the internal combustion engine is mounted on a vehicle, the cylinders are spaced from each other in a V-shape such that a first cylinder is inclined forward, and a second cylinder is inclined rearward, and wherein the control valve is provided behind the first cylinder with respect to the travel direction of the vehicle, and exhaust gas is introduced into the control valve from only the rearward inclined cylinder with respect to the travel direction of the vehicle.

8. An internal combustion engine mounted in a vehicle, the internal combustion engine comprising a crankcase, and a plurality of cylinders provided on the crankcase, the cylinders spaced from each other in a V-shape t such that at least one cylinder is inclined in a forward direction of the vehicle, and at least one cylinder is inclined in a rearward direction of the vehicle, the engine further comprising a control valve, and plural exhaust ports and plural intake ports communicating with an interior of each of the respective cylinders, wherein the control valve recirculates exhaust gas obtained from only an exhaust port of the at least one cylinder inclined in a rearward direction of the vehicle into each of the intake ports of the internal combustion engine, the control valve disposed in the V-shaped space between cylinders, and wherein channels are provided for supplying exhaust gas from the control valve to the intake ports of the plurality of cylinders.

9. The internal combustion engine according to claim 8, wherein the channels for supplying exhaust gas from the control valve to the intake ports of the plurality of cylinders comprise a single upstream passage connected to the control valve;

a branching chamber connected to the upstream passage, the branching chamber having a plurality of one-way valves for preventing backflow into the branching chamber from the intake ports of the cylinders; and a plurality of downstream passages connected at one end to the branching chamber through the one-way valves, and connected at another end to the intake ports of the respective cylinders.

10. The internal combustion engine according to claim 8, wherein the internal combustion engine is mounted on the vehicle in a transverse manner so that a crankshaft of the engine extends in a left and right direction with respect to a travel direction of the vehicle, and the cylinders are disposed offset with respect to each other in the left and right direction, the control valve is provided behind the at least one cylinder inclined in a forward direction of the vehicle.

11. The internal combustion engine according to claim 8, wherein the internal combustion engine further comprises an air intake member disposed between the at least one cylinder inclined in a forward direction of the vehicle and the at least one cylinder inclined in a rearward direction of the vehicle, and an air intake throttle is operatively connected to the air intake member, the control valve is disposed between the at least one cylinder inclined in a forward direction of the vehicle and the at least one cylinder inclined in a rearward direction of the vehicle so as to reside on one side of the air intake member, and the air intake throttle is disposed between the at least one cylinder inclined in a forward direction of the vehicle and the at least one cylinder inclined in a rearward direction of the vehicle so as to reside on a side of the air intake member opposed to the one side.

12. The internal combustion engine according to claim 8, wherein the control valve comprises an actuator portion and a valve portion, and the control valve is oriented on the engine such that the actuator portion overlies the valve portion.

13. The internal combustion engine according to claim 12, wherein the actuator portion is disposed above a cylinder head of the at least one cylinder inclined in a forward direction of the vehicle so as to be exposed to wind resulting from travel of the vehicle, and the valve portion is disposed behind the at least one cylinder inclined in a forward direction of the vehicle so as to be substantially protected from exposure to wind resulting from travel of the vehicle.

* * * * *